United States Patent [19]

van Zyl

[11] 4,402,101

[45] Sep. 6, 1983

[54] POWER POOL CLEANER

[76] Inventor: Robert M. van Zyl, 4074 Hillside Rd., Lafayette Hill, Pa. 19444

[21] Appl. No.: 291,043

[22] Filed: Aug. 7, 1981

[51] Int. Cl.[3] ..... E04H 3/20

[52] U.S. Cl. ..... 15/1.7; 15/49 C; 15/383

[58] Field of Search ..... 15/1.7, 349, 352, 383, 15/384, 389, 49 C, 50 C; 114/222

[56] References Cited

U.S. PATENT DOCUMENTS

| | | | |
|---|---|---|---|
| 3,200,433 | 8/1965 | Downey | 15/321 X |
| 3,321,787 | 5/1967 | Myers | 15/1.7 |
| 3,337,889 | 8/1967 | West | 15/1.7 |
| 3,460,188 | 8/1969 | Boyd | 15/383 |
| 3,509,589 | 5/1970 | Bond | 15/1.7 |
| 3,859,948 | 1/1975 | Romano et al. | 15/1.7 X |
| 3,950,809 | 4/1976 | Schatzmann | 15/1.7 |

*Primary Examiner*—Edward L. Roberts
*Attorney, Agent, or Firm*—Julian C. Renfro

[57] ABSTRACT

A submersible device for cleaning and scrubbing the bottom and/or sides of a pool or the like comprising a housing having a width in the left-right direction greater than its length. An elongate brush of a dimension approaching the width of the housing is mounted in the lower part of the housing, with the bristles of the brush protruding somewhat below the housing. An electric motor carried on the housing is utilized for driving the brush in rotation, and wheels on the underside of the housing enable it to roll along the bottom of the pool. The housing is made of flexible components such that a substantial portion of the width of the brush can remain in contact with the bottom of the pool as a result of flexing. I prefer to use a rotary brush whose bristles are in a double helix configuration such that encountered particles will be drawn toward the midpart of the housing. Suction will be applied at a location on the centerline of the housing. My invention utilizes a coin collector receptacle disposed in the flow path of water through the housing.

12 Claims, 8 Drawing Figures

POWER POOL CLEANER

BACKGROUND OF THE INVENTION

Swimming pool cleaning has long been a laborious hand operation involving two basic steps. First, the pool must be vacuumed to remove the settlement that has been deposited to the bottom of the pool. Then, the surfaces must be manually brushed to loosen the more tenacious particles or to remove stains. Particles loosened by this brushing action are typically left in suspension in the water and are hopefully removed in the pool filter system or, after settling out, by the next vacuuming operation.

In addition to the manual vacuum and brushing techniques, several types of "automatic" devices are on the market to clean swimming pools. One type of device currently available does little more than agitate the water with oscillating hoses, sufficiently to place the dirt in suspension in the hope that the dirt will be drawn through the pool filter system. With this system, the dirt is not removed from the bottom, where it naturally settles, but instead is found dispersed throughout the water, where it can be irritating if not harmful to the swimmer.

All of these devices must be powered by electric motors or high pressure pumps for a considerable length of time in order to cover the entire pool surface in a random pattern, and depending on the configuration of the device, will still leave settlement in "dead zones" in the pool. In addition, these prior art devices will not scrub stubborn particles or stains sufficiently to remove them, and furthermore will leave particles suspended in the pool water.

It was to overcome the many disadvantages of the prior art that the present invention was evolved.

SUMMARY OF THE INVENTION

A device for cleaning and scrubbing the bottom and/or sides of a pool in accordance with this invention comprises a housing typically having a width in the left-right direction greater than its length. An elongate brush of a dimension approaching the width of the housing is mounted for rotation in an elongate aperture in the lower part of said housing, and means are provided for driving the brush in rotation with its bristles in contact with the bottom of the pool.

The housing is equipped with a plurality of wheels such that it may be caused to roll along the bottom of the pool while the bristles of the brush are in scrubbing contact with the pool bottom for substantially the entire width of the brush. The brush as well as the housing may in one embodiment of this invention be made of flexible material such that a substantial portion of the width of the brush can remain in contact with the bottom of the pool as a result of flexing, even when curved portions of the pool bottom are being encountered. However, I am not to be limited to a device having flexibility, for obviously an embodiment of this invention utilizing comparatively rigid components can perform an excellent cleaning operation in many operational situations.

One of the important aspects of my invention is the synergistic action obtained as a result of an effective combining of brush action with the suction applied to the housing, typically by the application of suction from the surface by the use of a long hose. The bristles of the brush are preferably in a double helix arrangement serving to bring encountered particles toward the fore-aft centerline of the housing.

The suction manifests itself in a chamber running the length of the cavity in which the rotary brush is located, and as a consequence of the combined brush and suction action, a flow velocity is obtained which is greater than that achieved merely by the vacuum. This greater flow velocity combined with the vigorous scrubbing action of the rotating brush produces a cleaning effect greater than could be achieved with separate vacuum and brushing operations.

I am not to be limited to an arrangement for merely cleaning and scrubbing the bottom and sides of a pool, for in accordance with an important embodiment of this invention, I can use the brush and vacuum arrangement for picking up coins from the bottom of a fountain, reflecting pool or the like. In this embodiment I provide a coin collector receptacle on an upper part of the housing, in the flow path of water through the housing, into which receptacle the coins are drawn by the vacuum applied to the housing. These coins are received in a tray which can be readily removed from the device, emptied, and then returned to service.

It is therefore a principal object of this invention to provide a pool cleaning device for economical construction, efficient in operation and reliable in performance.

Another object of this invention is to provide a device that will thoroughly scrub the bottom of the pool and vacuum the loosened particles in one operation so that none are left in suspension, this being achieved with a minimum of labor.

A further object of this invention is to provide a device that will clean the bottom and side surfaces of a pool in the shortest possible time to conserve energy.

A yet further object of this invention is to provide a pool cleaning device of flexible construction that can operate satisfactorily even when curved portions of the pool bottom are being encountered.

A still further object of my invention is to provide a pool cleaning device having a coin collector receptacle in the flow path of water through the device, such that coins encountered on the bottom of a pool or fountain will be picked up and retained in the coin collector receptacle.

Yet still another object of my invention is to provide a pool cleaning device using a rotary brush for scrubbing the pool bottom, with the brush action in concert with vacuum applied to the device resulting in a highly effective synergistic action that rapidly and efficiently removes dirt and deposits from the pool.

These and other objects, features and advantages will be more obvious as the description proceeds.

DETAILED DESCRIPTION

Figure 1:
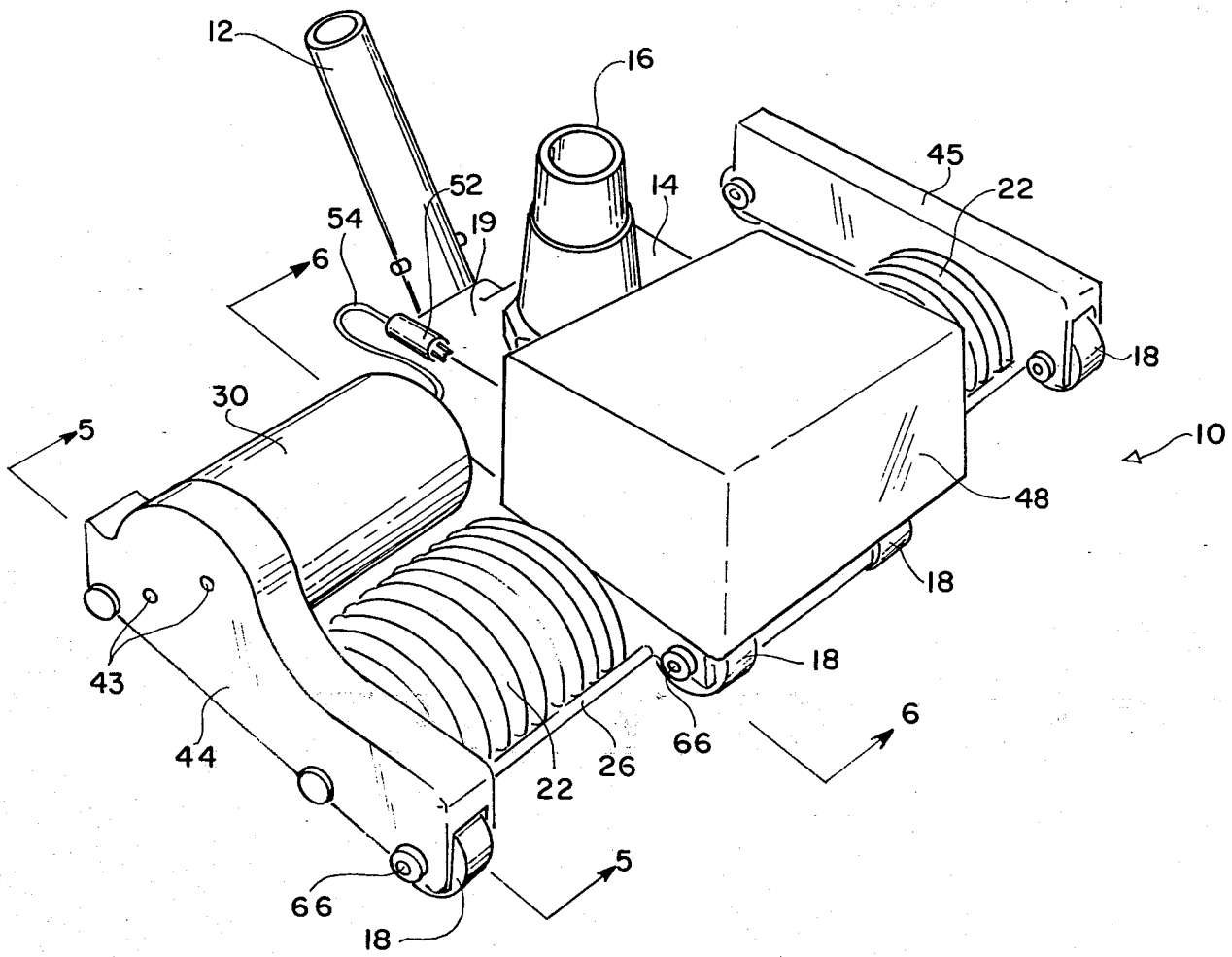
FIG. 1 is a perspective showing of a first embodiment of my novel submersible pool and fountain cleaner, revealing the device in approximately an operative position.

Turning first to FIG. 1, it will be seen that I have illustrated a power head assembly 10 in accordance with this invention, disposed approximately in an operative position, on the rear end of which is provided a swivel type yoke 12 such that the device can be guided along the bottom of a pool or the like by the use of a long pole (not shown) attached to the yoke.

The submersible power head assembly is principally constituted by a housing member 14, made of PVC or other suitable plastic, connected to an upper central portion of which is an upstanding vacuum outlet 16, which in turn connects to a chamber located on the underside of housing member 14. A flexible hose (also not shown) is utilized to connect the outlet 16 to a vacuum source, such as to the suction side of the pool filter pump. The manner in which the vacuum is utilized in my device in concert with a rotary scrub brush is of considerable importance to this invention, and is discussed at length hereinafter.

The housing member in an exemplary embodiment is approximately 18 inches wide in a left-right sense, and 9 inches from front to back, but obviously I am not to be limited to a device having these dimensions. A number of small wheels 18, typically eight in number, are utilized in a spaced array on the underside of the housing member, so that is may roll freely along the bottom of a pool; note FIG. 2 in particular. Because of the substantial dimension of this embodiment of my invention in a left-right sense, it is likely that it will need to bend or distort somewhat as curved portions of the bottom and sides of the pool are encountered. To this end, I construct the housing member 14 of this embodiment such that it possesses a substantial amount of flexibility, so that it can easily conform to the contours of the pool.

Figure 2:
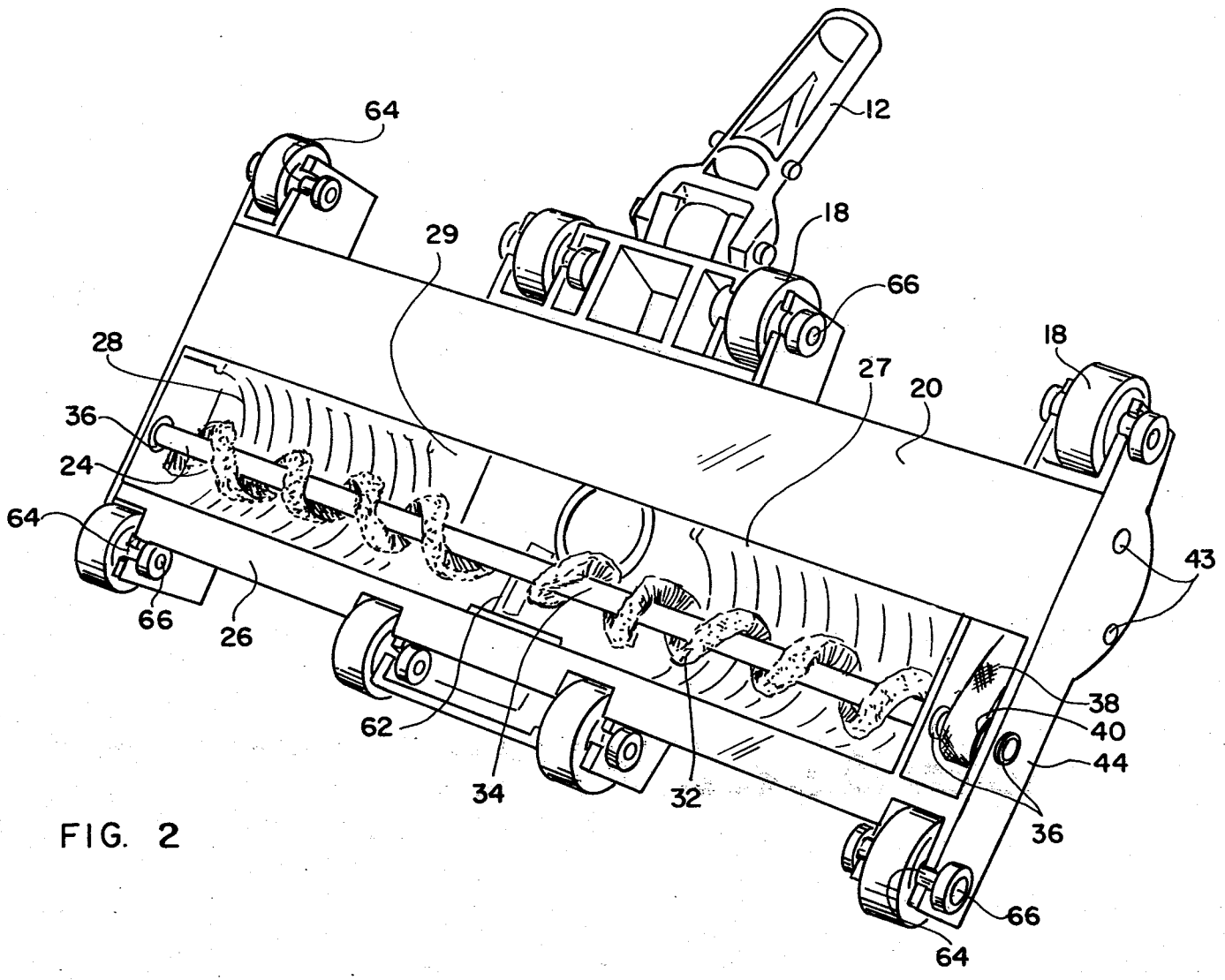
FIG. 2 is a showing of the underside of my novel device, with this view revealing the rotary brush having bristles in a double helix arrangement that serves to bring particles encountered on the bottom of a pool toward the fore-aft centerline of the housing.

As best seen in FIGS. 1 and 2, a flat plate 20 preferably of plastic $\frac{1}{8}''$ thick serves as a principal left-right member, and attached forwardly thereof is a portion 22 of arched configuration that serves to define an elongate cavity 28 extending across the width of the underside of the housing member, in which cavity an elongate brush 24 is driven in rotation. The portion 22 of arched configuration is typically a wire reinforced vinyl member generally resembling a flexible bellows. Forward of the member 22 is a plastic strip 26 that, like plate 20, runs essentially the full width of the housing.

As is thus to be seen, none of the laterally extending housing components of this embodiment are of a configuration to strongly resist bending, which means that at such time as a substantial amount of pool curvature is encountered, the plastic housing portions can deflect such that substantially all of the nylon bristles 32 of the rotating brush 24 can actively contact the bottom or side portions of the pool, and bring about the effective scrubbing action thereon.

As will be seen in FIG. 2 and subsequent figures, the elongate brush 24 is rotatably mounted in a lower part of the housing, and driven in rotation by a sealed electric motor 30 located on the upper part of the housing member 14, as depicted in FIG. 1. The relationship of the brush to the wheeled housing is such that the bristles 32 protrude to some extent below the forward part of the housing, so that they will firmly engage the bottom or sides of the pool. These bristles are mounted on a shaft 34 preferably of nylon that is $\frac{3}{8}''$ in diameter, which means that it is easily flexible enough to bend such that the bristles can reach curved or irregular surfaces. In this exemplary embodiment, the shaft 34 is approximately 18 inches long, and the bristles 32 are disposed in a double helix pattern.

It is to be noted that I am not to be limited to the use of a housing made up of flexible components, for the novel synergistic action described hereinafter is still effective in an instance in which the housing is made up of comparatively rigid components.

The double helix bristle pattern I prefer to use is illustrated in FIG. 2, and it is to be noted that this feature, in concert with the preferred direction of brush rotation, are such as to bring encountered dirt toward the fore-aft centerline of the housing, upon which centerline the vacuum outlet 16 is located.

Immediately rearward of brush 24 is elongate inlet 27, through which dirt and other particles dislodged by the brush can enter the interior of the housing. As will be noted from FIG. 2, the inlet 27 is coextensive with brush 24, and is in direct contact with the vacuum outlet 16.

Figure 3:
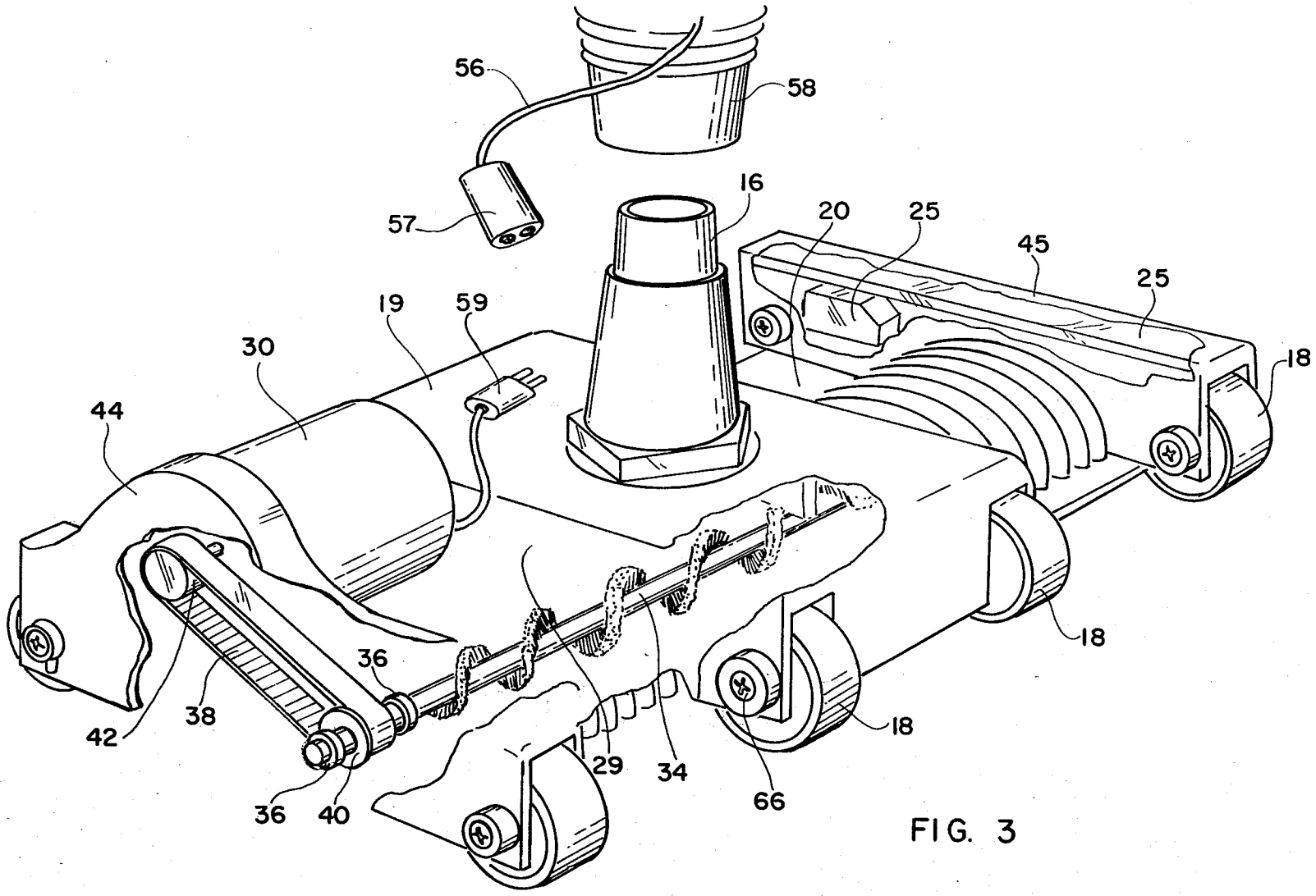
FIG. 3 is a perspective view of a different embodiment in that no self contained battery is utilized for powering the rotary brush, with a portion of this view being sectionalized in order to reveal internal construction.

It is to be noted that the outlet 16 is not mounted upon the flat plate 20, but rather is mounted upon a platform 19 disposed approximately $1\frac{3}{4}$ inches above the plate 20; note FIG. 3. The platform 19 may be considered as extending for approximately seven inches in the fore-aft dimension of the housing member, and for $4\frac{1}{2}$ inches in the left-right dimension.

The forwardmost and rearmost portions of the raised platform as well as much of their side portions may be regarded as closed so as to define a chamber 29, but the sides of the platform 19 in the vicinity of the arched member 22 are open, such that solids and liquids drawn into the elongate cavity 28 by the action of the rotating brush and the applied suction can readily move through chamber 29 toward the fore and aft centerline of the housing member, and thence into vacuum outlet 16.

Returning to a consideration of the rotary brush 24, friction is minimized by disposing a nylon bearing 36 at the housing contacting locations at each end of shaft 34, and as will be noted in FIGS. 2 and 3, the brush is driven in rotation by means of a belt 38 passing around a pulley 40 at one end of the brush, as well as a pulley 42 mounted on the shaft of watertight motor 30. The preferred rotational direction of the brush 24 is such as to tend to move the power head assembly forwardly.

Figure 5:
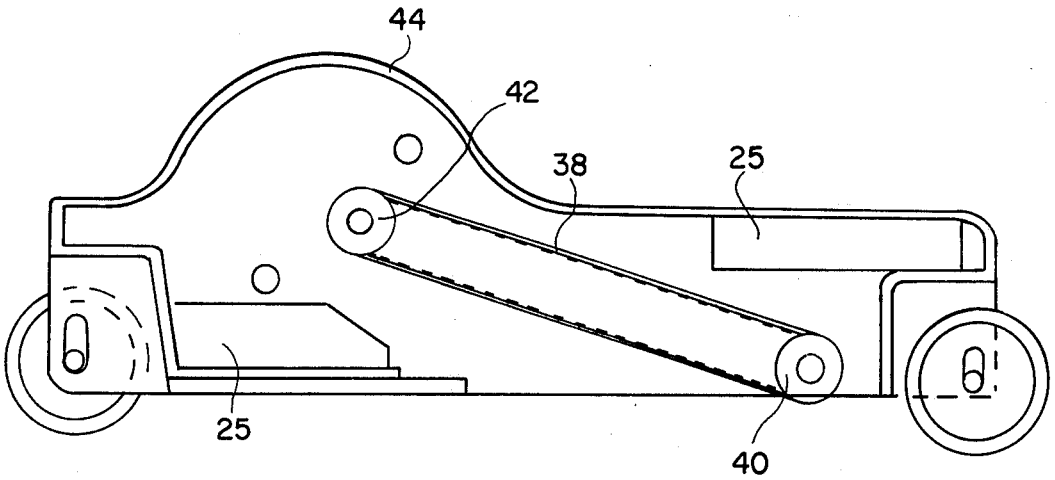
FIG. 5 is a sectional view taken along lines 5—5 in FIG. 1.

To prevent undesired slippage, the belt 38 I use is preferably a timing belt. As illustrated in FIG. 5, this belt is equipped with a plurality of teeth on its underside or inner surface that are arranged to mesh with teeth located upon the pulleys associated with the rotating brush and the driving motor.

As will be noted from several of the early figures of drawing, the wheels 18 located near the ends of the housing member 14 are located at the bottom portions of end members 44 and 45. These end members extend principally in the fore and aft direction, and on the undersides of these end members, the plate 20 and the forward strip 26 terminate. The end members are preferably each in the configuration of a small enclosure in that they each have left and right portions spaced approximately ¾th inch apart such that a wheel 18 can be accommodated at the front end and the back end of these left and right portions. Each wheel 18 associated with the end members 44 and 45 is disposed upon a respective bolt 66, and an appropriate slot 64 is formed in the left and right members constituting the members 44 and 45. Such slots rather than holes are utilized in that slots make it conveniently possible to move the bolts 66 upwardly or downwardly until an appropriate initial heightwise adjustment of the wheels 18 has been achieved. Similarly, this arrangement simplifies the making of height adjustments later needed in order that the wear of the bristles 32 of the brush 24 can be compensated for. FIG. 2 makes clear many of these details including the fact that belt 38 as well as the pulleys 40 and 42 can be readily accommodated in the space between the two sides of member 44.

It will be noted from FIG. 2 that I provide at least one mid support 62 for the brush 24. At such time as the housing of the flexible embodiment of my invention is caused by pool contours to undertake a bending motion, the support 62 serves to maintain the brush in a proper operating relationship such that firm contact of the bristles 32 with the bottom surface of the pool is assured. Firm contact is also assured by the fact that I use a number of lead weights 25 disposed at spaced locations on the housing members, in order to negate any tendency for it to float away from an intended spot to be cleaned.

Any one of several suitable power sources can be used for driving the brush 24 in rotation, but I prefer to utilize the previously mentioned motor 30, which is operably mounted upon the upper rear portion of the housing. Preferably the motor is secured upon end member 44 by the use of mounting bolts 43. In the embodiment of FIG. 1, the motor 30 is supplied with electric power from a 12 volt battery 46 disposed in a battery holder 48 attached to the upper surface of platform 19 in front of the vacuum outlet 16. In one embodiment, I utilized a motor manufactured by Barber-Coleman and having a 750 rpm output with 35 inch ounces of torque. In this first embodiment, a female type of electric connector 50 is attached to the battery holder (see FIG. 4), at a location convenient to the motor 30, such that a male connector 52 mounted on a short cord 54 attached to the motor, can be readily attached thereto. I have found that in typical instance, the brush can be driven in rotation for from 100 to 120 minutes by the battery. Thereafter, when the power head assembly has been removed from the water, the connection to the motor 30 can be broken and a battery charger connected to terminal 50 so that the battery 46 can be recharged.

Other batteries can be used, and as a result, either longer or shorter running times can be obtained. The running times mentioned above are associated with a battery made by Elpower Corporation.

FIG. 3 represents a version of my invention in which a battery is not used, but rather power is supplied to the motor 30 by means of electric cord 56 integral with the vacuum hose 58. The cord, bringing electric power from a poolside source, can run through the interior of the hose, but I prefer for the cord to helix about the exterior of the hose 58, with an external plastic covering being used in order to minimize abrasion of the cord. An electrical connector 57 on the end of cord 56 is arranged to readily connect with connector 59 associated with motor 30.

Figure 4:
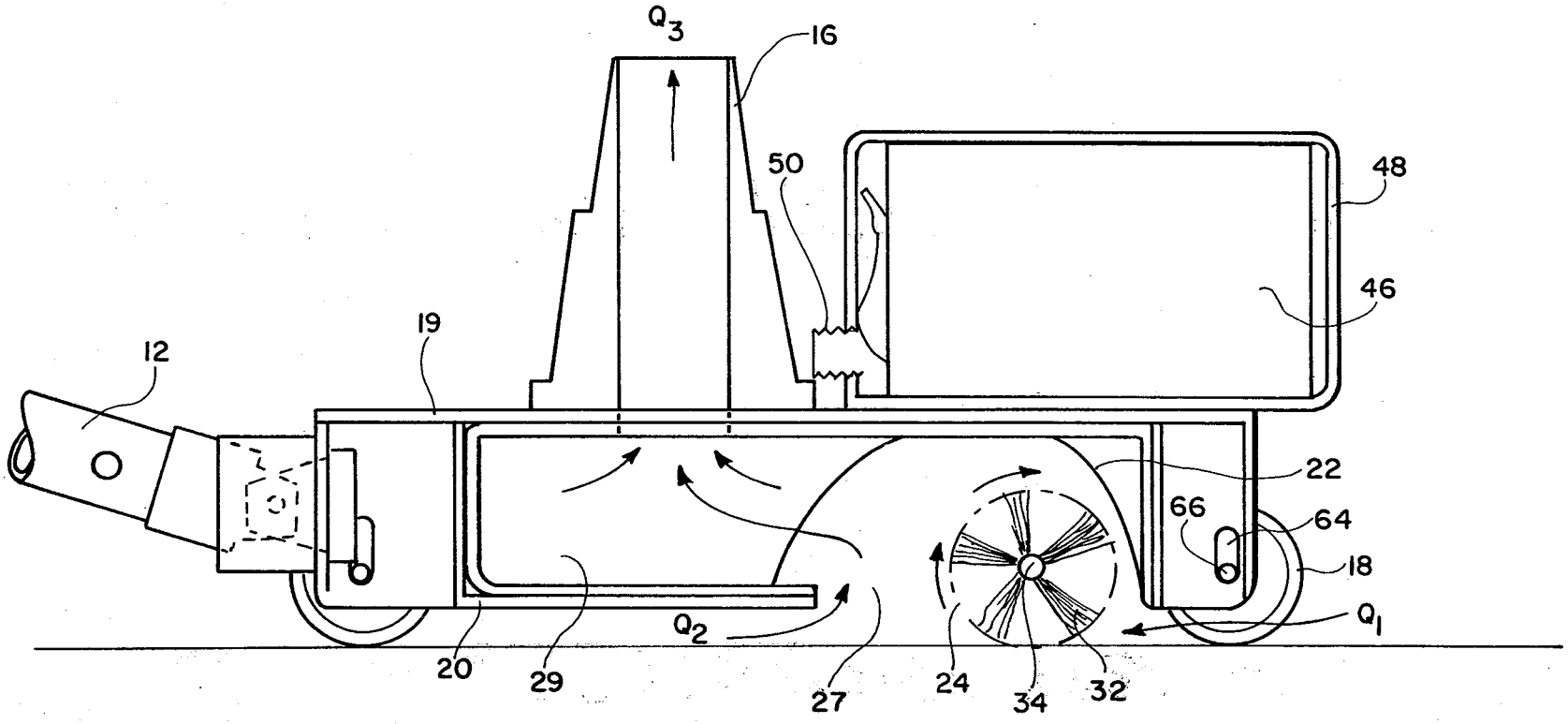
FIG. 4 is a view taken along the fore-aft centerline of FIG. 1 in order to reveal the flow paths of water through the various chambers of the device that occur as a result of the pumping action of the rotary brush and the suction applied at the suction outlet.

Turning to FIG. 4, it will be seen that I have there utilized a cross-sectional view of my novel power head in order to reveal some of the previously described relationships in greater detail. Visible in this figure is the upstanding vacuum outlet 16 which resides upon platform 19, as previously described. The outlet 16 has a hollow interior, providing effective communication with the chamber 29 defined in the interior of platform 19. As should be apparent, both the interior of outlet 16 and the chamber 29 freely connect with the elongate cavity 28 defined by the left and right members 22 of arched configuration, and the inlet 27. Also visible in this figure are the battery 46 residing in case 48, and the connector 50 by means of which power from battery 46 may be supplied to the motor 30, latter of course not being visible in this section taken along the fore and aft centerline of the machine.

The rotating spiral brush configuration illustrated with particular clarity in FIG. 4 results in a unique cleaning action that is synergistic, that is, results in a combined cleaning action that is greater than can be attained by the individual brushing and vacuuming operations. As will be understood from FIG. 4, the rotation of the spiral brush 24 results in a pumping action as a quantity of water $Q_1$ is drawn thereby into the housing. The pool vacuum system is also drawing in a quantity of water, $Q_2$, during the same period of time through the remaining available opening 27. The total of these two quantities, $Q_3$, must be drawn through the suction outlet 16 of the housing. As is evident in this figure, the available opening for water to enter the housing is the area of approximately one half of the opening 28. This is because the leading edge opening forward of brush 24 is associated with the brush "pumping" action, and is thus not available for the vacuum flow. The net result of this is a vacuum flow velocity associated with $Q_2$ that is through the opening 27 aft of the brush 24, which is considerably greater than a "conventional" vacuum head of the same width. This greater vacuum velocity, which is combined with the vigorous scrubbing action of the rotating brush, produces a cleaning effect greater than can be achieved with separate vacuuming and brushing operations.

Because the vacuuming and brushing operations are performed together, and since the unit is guided over the pool surface by the operator in a regular pattern and not in a random manner, the entire operation of cleaning the pool is achieved much more efficiently, completely, and with a considerable energy savings. Importantly, particles loosened by the brush are collected immediately by the vacuum, and thus are not placed in suspension in the water of the pool.

Figure 6:
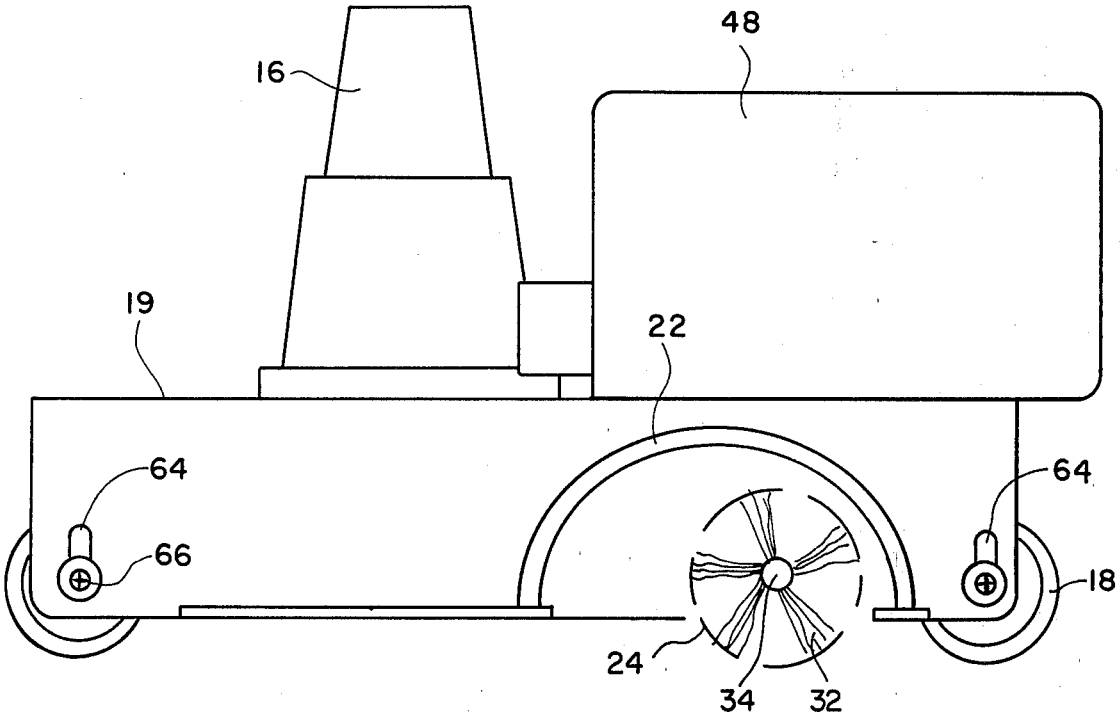
FIG. 6 is a sectional view taken along lines 6—6 in FIG. 1.

In FIGS. 5 and 6, I have shown cross sectional views taken along lines 5—5 and 6—6 respectively in FIG. 1 in order to reveal internal construction. Certain components of the lead weight arrangement are visible at 25 in FIG. 5, and in FIG. 6 some of the slots 64 associated with the height adjustment of the wheels are to be seen.

Figure 7:
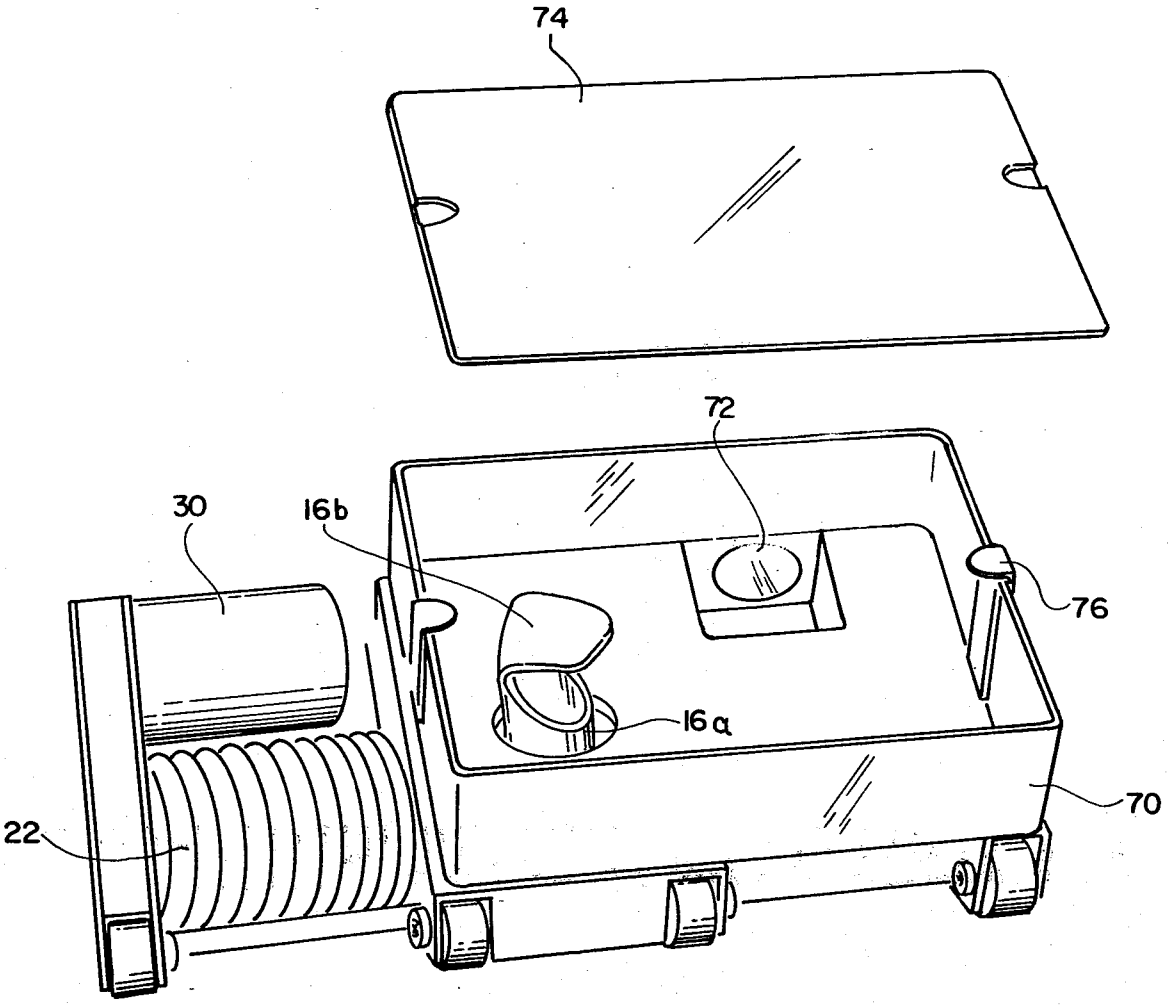
FIG. 7 is a view of an embodiment of my device concerned with the collection of coins from a fountain, reflecting pool or the like, with the removable coin tray not being shown in this figure for reasons of clarity.
Figure 8:
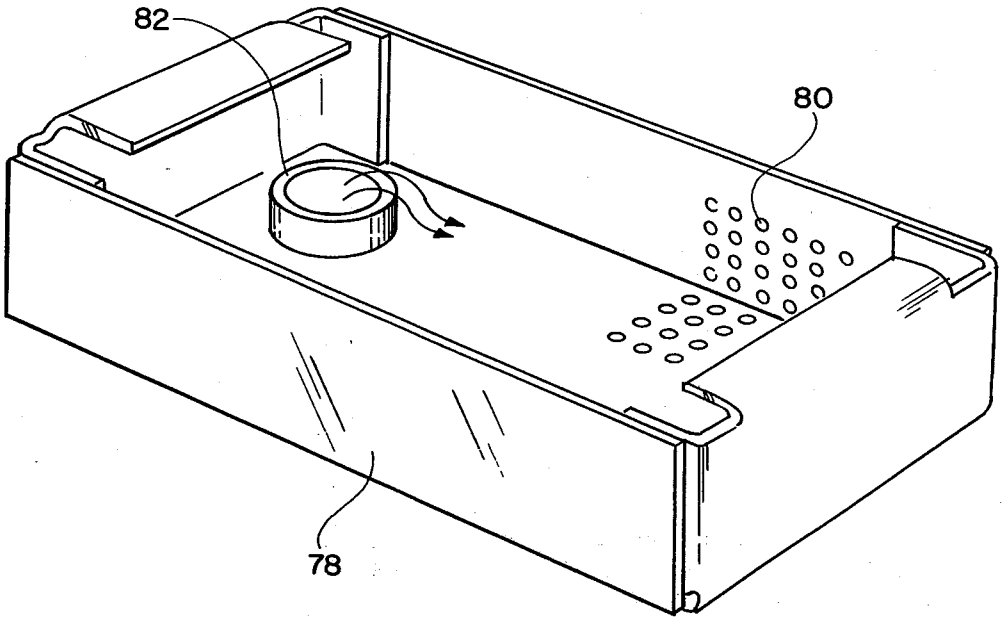
FIG. 8 is a perspective view of the removable coin tray designed for use in the coin receptacle illustrated in FIG. 7.

Turning to FIG. 7, it will be seen that I have there illustrated an embodiment of my invention concerned with the pickup of coins from the bottom of a fountain or the like. The housing member 14 is virtually the same as described in the previous embodiments of my invention, except that no battery holder 48 is mounted on the platform 19 as was the arrangement in FIG. 1. Rather, the upstanding member 16 of FIG. 1 has been foreshortened and modified, and upon this member a coin collector receptacle 70 is secured in surrounding relation, preferably by cementing it to the top of platform 19. A suitable hole is of course provided in the bottom of the coin receptacle so as to permit the modified member 16*a* to extend into the receptacle 70 when the receptacle has been secured in its operative position.

A connection to a source of vacuum, such as to the suction side of the pool filter pump is still employed, but in this embodiment the source of suction is connected to a member 72 located at the rear of the coin housing. As a result, a flow path through the housing is created, inasmuch as coins entering inlet opening 27 pass into chamber 29 and thence up through the vacuum outlet 16*a* into the coin receptacle 70. If the coins are not encountered near the fore-aft centerline of the machine, they then pass through a portion of the elongate cavity 28 on their way to the chamber 29.

The operation of the rotary brush 24 is such as to "flick" the edge of each encountered coin, and thus initially lift it off the bottom of the fountain, and at least partly because of the double helix bristle arrangement, such coins are directed to the center section of the housing, to the location of chamber 29.

The strong vacuum manifested in the chamber 29 is sufficient to pull the coins of a wide variety of sizes and weights upward through the member 16*a*, with the deflection member 16*b* of the top of 16*a* serving to redirect the flow of water and coins laterally so as to prevent the cover 74 of the housing from being forced off. The cover is normally held in place by clips 76.

I prefer to utilize a removable coin tray 78, preferably of plastic, inside the coin collector receptacle in order to simplify the emptying of coins from the housing, and such tray is generally of the configuration of the housing except that it is sufficiently smaller such that it can be received therein. Perforations 80 are utilized in the tray 78 such that a continuous flow of water, and the coins carried thereby, will be permitted therethrough. A shoulder 82 around the entry hole prevents the coins from falling out when the tray is removed.

The motor 30 of this embodiment is preferably powered in a manner similar to that shown in FIG. 3, that is, by an extension cord contained in or associated with the vacuum hose 58.

I claim:

1. A device for cleaning and scrubbing the bottom and/or sides of a pool or the like, comprising a housing, an elongate brush of a dimension approaching the width of the housing, mounted for rotation in an elongate aperture in the lower part of said housing, a sealed electric motor for driving said brush in rotation, with its bristles in contact with the bottom of the pool, said housing being equipped with a plurality of wheels such that it may be caused to roll along the bottom of the pool, while bristles of the brush are in vigorous scrubbing contact with the bottom of the pool for substantially the entire width of the brush, said brush as well as said housing being made of flexible material such that a substantial portion of the width of the brush can remain in contact with the bottom of the pool as a result of flexing, even when curved portions of the pool bottom are being encountered.

2. The device for cleaning and scrubbing as defined in claim 1 in which the bristles of said elongate brush are in a double helix configuration, such that particles removed from the bottom of the pool will be drawn toward the mid part of the housing.

3. A device for cleaning and scrubbing as defined in claim 1 in which said means for driving said brush in rotation is an electric motor powered by a rechargable battery.

4. The device for cleaning and scrubbing as defined in claim 1 in which said means for driving said brush in rotation is an electric motor powered by means of an extension cord.

5. A device for cleaning and scrubbing the bottom and/or sides of a pool or the like, comprising a housing having a width in the left-right direction greater than its length, an elongate brush of a dimension approaching the width of said housing, mounted for rotation in an elongate aperture in the lower part of said housing, means for driving said brush in rotation, with its bristles extending below said housing so as to be able to contact the bottom of the pool, said housing being equipped with a plurality of wheels such that it may be caused to roll along the bottom of the pool, while bristles of the brush are in scrubbing contact with the bottom of the pool for substantially the entire width of the brush, means defining a chamber along substantially the width of said brush, to which chamber a strong suction can be applied, the effect of the suction combined with the scrubbing action of the rotary brush resulting in dirt and other particles being effectively removed from the pool bottom and drawn into said aperture, and thereafter carried into the vacuum system, a coin collection receptacle mounted on said housing, in the flow path of water through said housing, means for applying suction to said coin receptacle so as to cause a flow of water therethrough, with the result that coins encountered by said rotary brush will be caused by a combination of brush action and suction to move upwardly into said coin receptacle, where they will be retained, and access means on said coin receptacle to enable collected coins to be periodically removed.

6. A device for cleaning and scrubbing as defined in claim 5 in which said means for driving said brush in rotation is an electric motor powered by a rechargable battery.

7. The device for cleaning and scrubbing as defined in claim 5 in which said means for driving said brush in rotation is an electric motor powered by means of an extension cord associated with a tube utilized to apply suction to said housing.

8. A device for cleaning and scrubbing the bottom and/or sides of a pool or the like, comprising a housing, an elongate brush of a dimension approaching the width of the housing, mounted for rotation in an elongate aperture in the lower part of said housing, electric motor means for driving said brush in rotation, with its bristles extending below said housing so as to be able to contact the bottom of the pool, said housing being equipped with a plurality of wheels such that it may be caused to roll along the bottom of the pool, while bristles of the brush are in scrubbing contact with the bottom of the pool for substantially the entire width of the brush, said brush as well as said housing being made of flexible material such that a substantial portion of the width of the brush can remain in contact with the bottom of the pool as a result of flexing, even when curved portions of the pool bottom are being encountered, means defining a chamber along substantially the width of said brush, to which chamber a strong suction can be applied, the effect of the suction combined with the vigorous scrubbing action of the rotary brush resulting in dirt and other particles being effectively removed from the pool bottom and drawn into said aperture, and thereafter carried into the vacuum system.

9. The device as defined in claim 8 in which the suction is applied at a location on the fore-aft centerline of said housing, and the bristles of said rotary brush are in a double helix configuration serving to bring encountered particles toward the centerline of said housing.

10. The device as defined in claim 8 in which a coin collector receptacle is mounted on said housing, in the flow path of water through said housing, means for applying suction to said coin receptacle so as to cause a flow of water therethrough, with the result that coins encountered by said rotary brush will be caused by a combination of brush action and suction to move upwardly into said coin receptacle, where they will be retained, and access means on said coin receptacle to enable collected coins to be periodically removed.

11. The device as defined in claim 10 in which said means for driving said brush in rotation is an electric motor powered by a rechargable battery.

12. The device as defined in claim 10 in which said means for driving said brush in rotation is an electric motor powered by means of an extension cord associated with a tube utilized to apply suction to said housing.

* * * * *